US007326093B2

(12) United States Patent
Tsumiyama et al.

(10) Patent No.: US 7,326,093 B2
(45) Date of Patent: Feb. 5, 2008

(54) PERSONAL WATERCRAFT

(75) Inventors: Yoshinori Tsumiyama, Miki (JP); Takahide Komoriya, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/483,261

(22) Filed: Jul. 7, 2006

(65) Prior Publication Data

US 2007/0037458 A1 Feb. 15, 2007

(30) Foreign Application Priority Data

Jul. 12, 2005 (JP) ..... 2005-202600

(51) Int. Cl.
*F01P 3/20* (2006.01)

(52) U.S. Cl. ..... 440/88 N; 114/55.57; 440/88 G

(58) Field of Classification Search ..... 440/88 N, 440/88 G, 88 J, 88 B, 88 C; 114/55.57
See application file for complete search history.

(56) References Cited

U.S. PATENT DOCUMENTS 5,393,252 A * 2/1995 Brogdon ..... 440/88 R
5,813,888 A * 9/1998 Ozawa ..... 440/88 N
6,145,458 A * 11/2000 Hattori ..... 114/55.57
6,997,766 B1 * 2/2006 Brogdon et al. ..... 440/88 N
7,114,469 B1 * 10/2006 Taylor ..... 123/41.08

FOREIGN PATENT DOCUMENTS

JP 2003-063497 3/2003

* cited by examiner

*Primary Examiner*—Ed Swinehart
(74) *Attorney, Agent, or Firm*—Alleman Hall McCoy Russell & Tuttle LLP

(57) ABSTRACT

A personal watercraft equipped with an engine cooling system and a cleaning system therefore, including a body 1 including a deck 3 and a hull 2, an engine E accommodated in the interior of the body 1, a cooling system configured to cool the engine E using water taken in from outside the body 1, and a flush pipe 39, one end of which is coupled to the cooling system to guide cleaning water to the cooling system, and an opposite end of the cleaning water supply line has an opening that is formed on the deck 3 of the body 1 and is configured to open outward; and a coupling member 40 is attached to the opening to couple the cleaning water supply line to a cleaning water supply source located outside the body.

5 Claims, 11 Drawing Sheets

PERSONAL WATERCRAFT

BACKGROUND OF THE INVENTION

1. Field of the Invention

The present invention relates to a personal watercraft. More particularly, the present invention relates to a personal watercraft equipped with a cooling system of an engine and a cleaning system for cleaning the cooling system.

2. Description of the Related Art

In recent years, water jet-propulsion personal watercraft have been widely used in leisure, sport, or rescue activities. The personal watercraft is equipped with a water jet pump and an engine that drives the water jet pump in a space in an interior of the watercraft that is defined by a hull and a deck. The water jet pump operates to pressurize and accelerate water sucked from a water intake provided on a hull bottom surface and eject it rearward. Thereby, the watercraft obtains a propulsion force to move a body thereof. Typically, the personal watercraft is equipped with a cooling system configured to take in water from outside to cool the engine, etc, as disclosed in Japanese Laid-Open Patent Application Publication No. 2003-63497.

As shown in FIG. 11, the cooling system is configured to take in, as cooling water, a part of pressurized water such as sea water or lake water from inside the water jet pump through a water drawing pipe (cooling water pipe) 61 coupled to a pump casing of the water jet pump. The cooling water taken in is supplied to a cylinder block 63 of an engine 62, a cylinder head 64 of the engine 62, an exhaust passage such as an exhaust manifold 65, an exhaust pipe 66, and an expansion chamber 67, etc to cool these components. In this personal watercraft, the cooling water taken in from outside the watercraft cools the engine 62 and the exhaust passage. After that, some of the cooling water is discharged into a pump room for the water jet pump through a water discharge pipe 68 and the remaining cooling water is discharged outside the watercraft together with an exhaust gas through a water muffler 79 and an exhaust duct 70.

In addition to the water discharge pipe 68, the exhaust duct 70, and the cooling water pipe 61, the personal watercraft is provided with a second water discharge pipe 71 to effectively discharge the sea water or the lake water remaining in a cooling water passage after the watercraft is landed. The second water discharge pipe 71 is coupled to a region of the cooling water pipe 61 between the water jet pump and the engine 62. To be specific, the second water discharge pipe 71 is coupled to the region of the cooling water pipe 61 that is located upstream of the exhaust manifold 65 of the engine 62 and in close proximity to a filter 72 attached to the cooling water pipe 61. To enable the filter 72 to be easily accessed from outside the watercraft, the filter 72 is disposed at a relatively high location in the interior of an engine room. This inevitably lowers a region of the cooling water pipe 61 that is located between the filter 72 and the engine 62. The second water discharge pipe 71 is coupled at the above mentioned location to sufficiently discharge the water remaining in the lowered region of the cooling water pipe 61. A water outlet 71*a* of the second water discharge pipe 71 opens in a rear end surface of a hull.

In the personal watercraft including the cooling system constructed above, unwanted substances such as small stones or sea weed tend to remain in the cooling water passage or salt contained in the sea water tends to adhere to an inner wall surface thereof. To solve this, in the above personal watercraft, cleaning water is flowed into the cooling water passage from outside through the second water discharge pipe 71 to clean (hereinafter also referred to as flush) the interior of the cooling water passage. To be specific, cleaning water such as city water is supplied through the second water discharge pipe 71 from the water outlet 71*a* and is discharged from the water discharge pipe 68 or the exhaust duct 70 through the cooling water passage. The second water discharge pipe 71 serves as a cleaning water supply pipe and the water outlet 71*a* thereof serves as a cooling water inlet.

In the above personal watercraft, the water outlet 71*a* of the second water discharge pipe 71 is located at the rear end surface of the hull, and a coupling member by which the second water discharge pipe 71 is coupled to the cleaning water supply pipe protrude outward therefrom. Therefore, with the watercraft on a loading space of a trailer or a lift, the coupling member is difficult to access when coupling the cleaning water supply pipe to the second water discharge pipe. Because the bottom surface or a side surface of the hull is a planing surface, it is undesirable to protrude a member of the cleaning water inlet from these surfaces in order to avoid negative effect on planing capability. In addition, it is undesirable to mount the member which may spoil an external appearance of the watercraft.

Instead of forming the cleaning water inlet on an outer surface of the body, in a conventional method, a hatch cover or a seat is opened, an opening of the deck is opened, and a cleaning water supply hose is directly connected to a connecting port formed at the water cooling pipe of the engine to flush the cooling water passage. In this case, however, the hatch cover or the like must be opened while the cleaning water supply hose is connected to the cooling water passage. This undesirably causes a noise to be emitted outside from the engine.

SUMMARY OF THE INVENTION

The present invention has been developed to solve the above mentioned problem, and an object of the present invention is to provide a personal watercraft that allows a cooling system of an engine to be cleaned using cleaning water without opening an engine room and allows a flush kit for coupling a cleaning water supply pipe to the cooling system to be disposed on an outer surface of the watercraft so as not to interfere with a body of a rider and so as not to spoil an external appearance of the watercraft.

A personal watercraft of the present invention comprises a body including a deck and a hull; an engine accommodated in an interior of the body; a cooling system configured to cool the engine using water taken in from outside the watercraft; a cleaning water supply line, one end of which is coupled to the cooling system to guide cleaning water to the cooling system, and an opposite end of which has an opening that is formed on the deck of the body and is configured to open outward; and a coupling member that is attached t the opening to couple the cleaning water supply line to a cleaning water supply source located outside the body.

In such a construction, since it is not necessary to open an engine room to clean the cooling system, a noise of a rotating engine that may be scattered around the watercraft can be suppressed. In addition, since the coupling member for coupling the cleaning water supply line to the cleaning water supply source is not formed on the hull, negative effect of the coupling member on planing capability can be avoided. Furthermore, the coupling member can be easily accessed to supply the cleaning water to the cleaning water supply line.

It is preferable that the opening may be formed on a bottom portion of a concave portion formed on an outer surface of the deck.

Since the coupling member is attached to the concave portion of the outer surface of the deck, it does not protrude from the outer surface of the deck.

It is preferable that the opening may be located at or in close proximity to a bent portion of a line forming an outer shape of the deck.

For example, the concave portion is easily formed on the bent portion of the line when the concave portion is formed on the outer surface of the deck. In addition, the coupling member is less noticeable because it is attached to the bent portion, and thus does not substantially affect the external appearance of the watercraft.

For the above stated reason, the bent portion of the line formed on the outer surface of the deck may be a line forming an outer shape of the deck.

Preferably, in the personal watercraft may further comprise a swelling portion that is formed at a center section in a width direction of the deck and at a rear portion in a longitudinal direction of the deck to allow a seat straddled by a rider to be mounted thereover; the concave portion provided with the opening may be formed on a surface of the swelling portion and is located substantially just below the seat.

This is because, the coupling member is attached to the concave portion located substantially just below the seat, and thus is covered with the seat from above so as not to interfere with a body of the rider. In addition, the coupling member is desirably less noticeable.

For the above stated reason, in the straddle-type personal watercraft, it is preferable that the opening may be formed on a side surface of the swelling portion and is located substantially just below a bent portion of a line forming an upper end surface of the swelling portion as viewed from laterally.

It is preferable that the side surface of the swelling portion on which the opening is formed may be a left side surface of the body as viewed from rearward.

This is because the left side of the body is a port side, and typically contacts a pier or a boatslip when the watercraft is anchored at the pier or the boatslip, and therefore, the coupling member is easily accessible.

The above and further objects and features of the invention will more fully be apparent from the following detailed description with accompanying drawings.

DETAILED DESCRIPTION OF THE PREFERRED EMBODIMENTS

Hereinafter, an embodiment of a personal watercraft (also referred to as a watercraft) of the present invention will be described with reference to the accompanying drawings.

Figure 1:
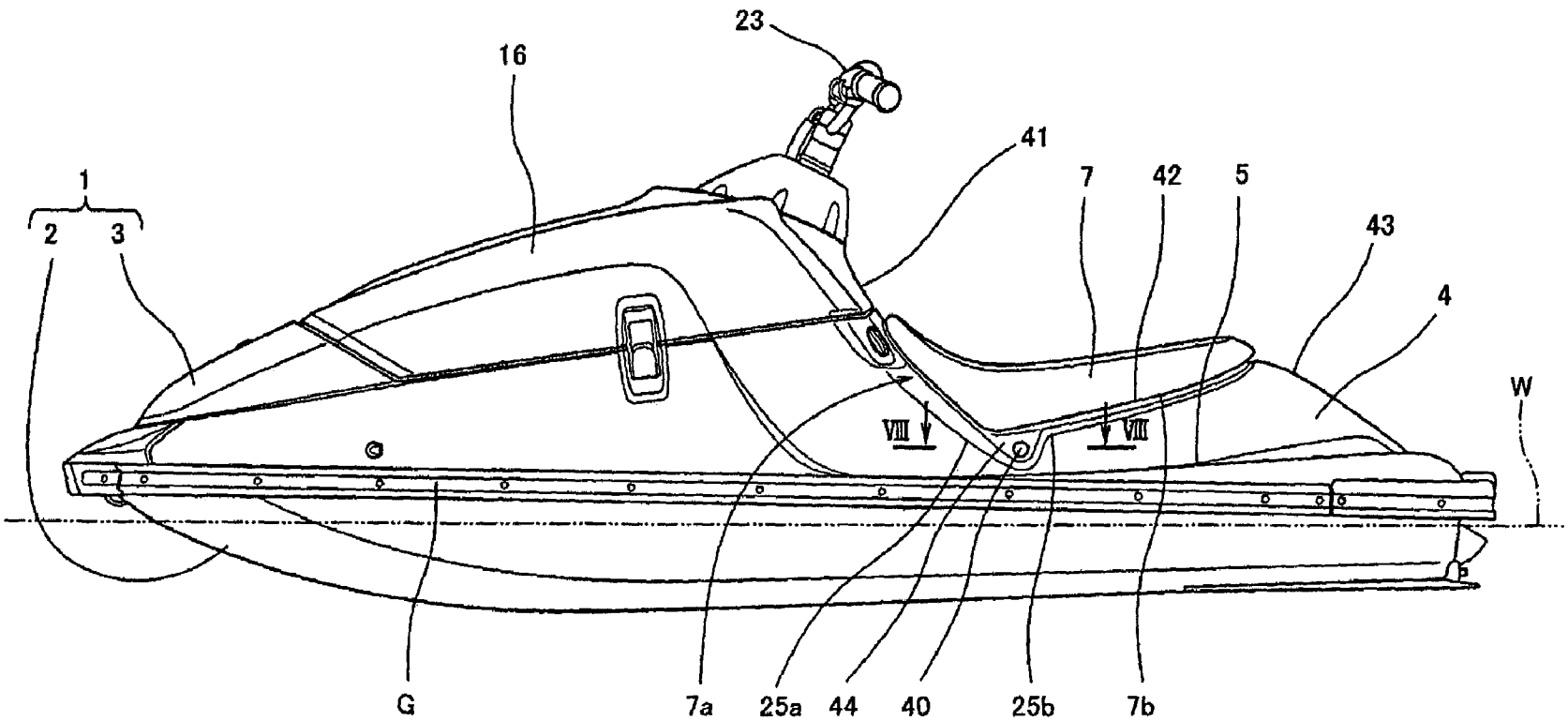
FIG. 1 is a side view of a personal watercraft according to an embodiment of the present invention.
Figure 2:
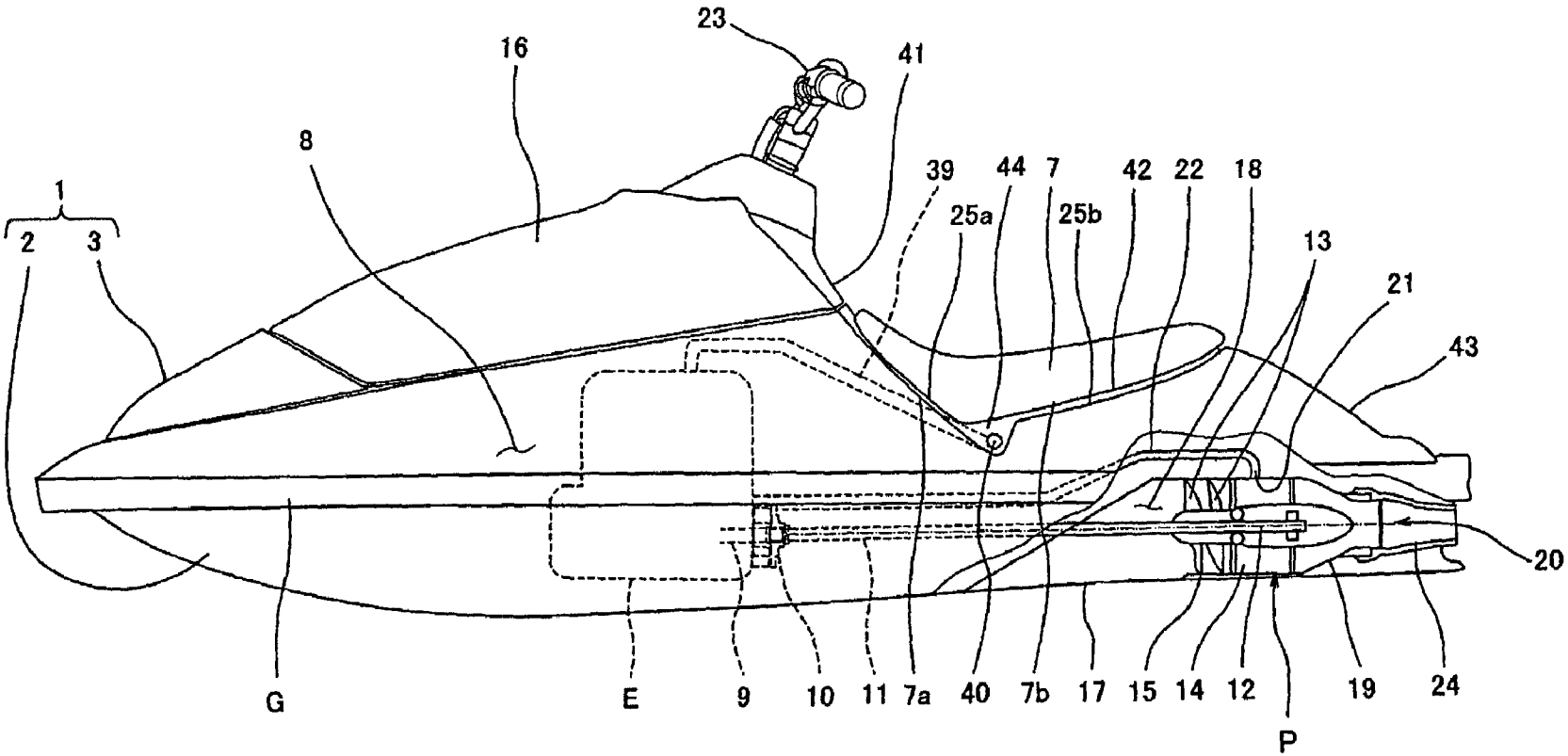
FIG. 2 is a partially cut away side view of the watercraft of FIG. 1, showing a water jet pump which is a propulsion system of the personal watercraft of FIG. 1.
Figure 3:
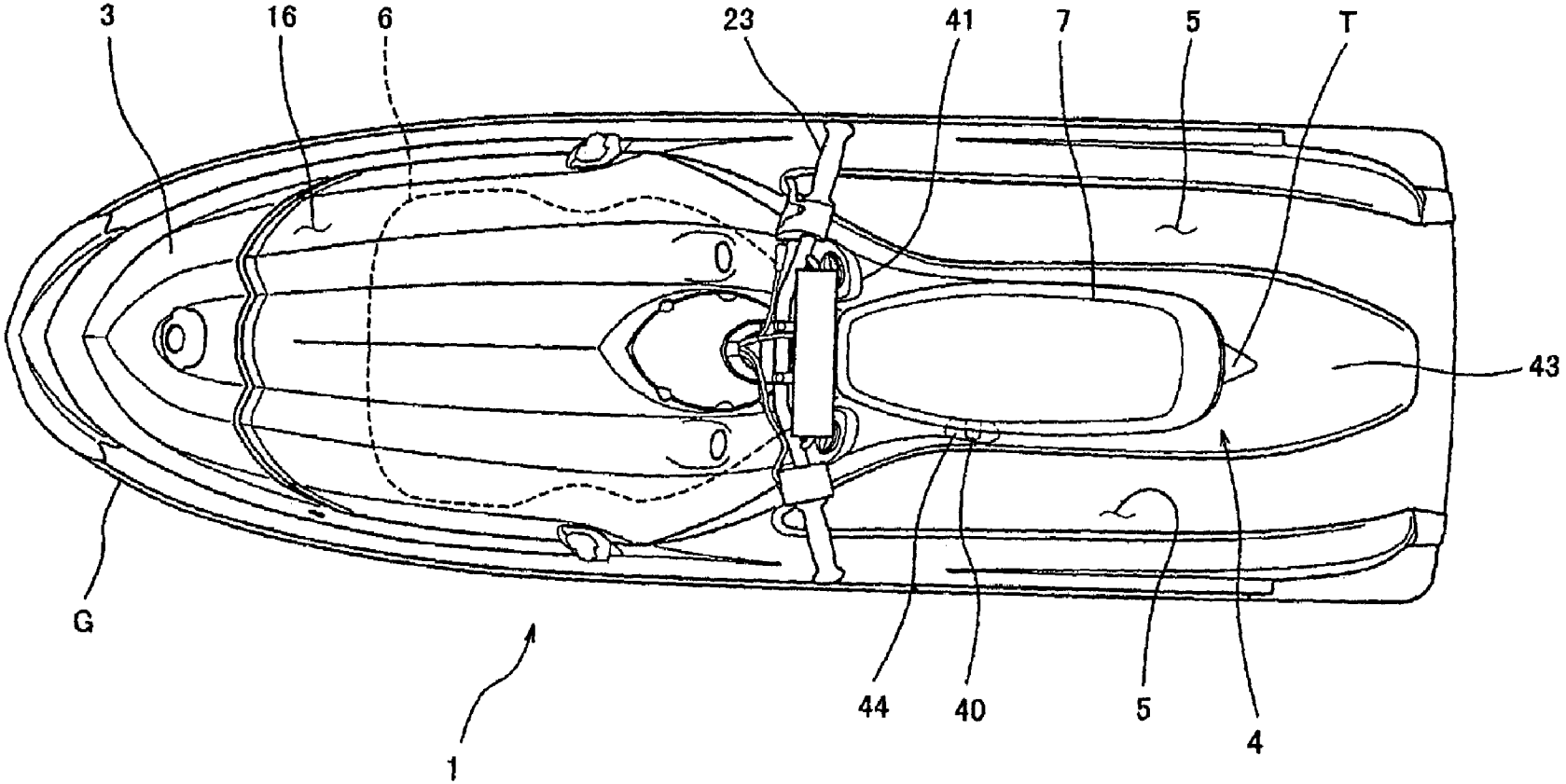
FIG. 3 is a plan view of the personal watercraft of FIG. 1.
Figure 4:
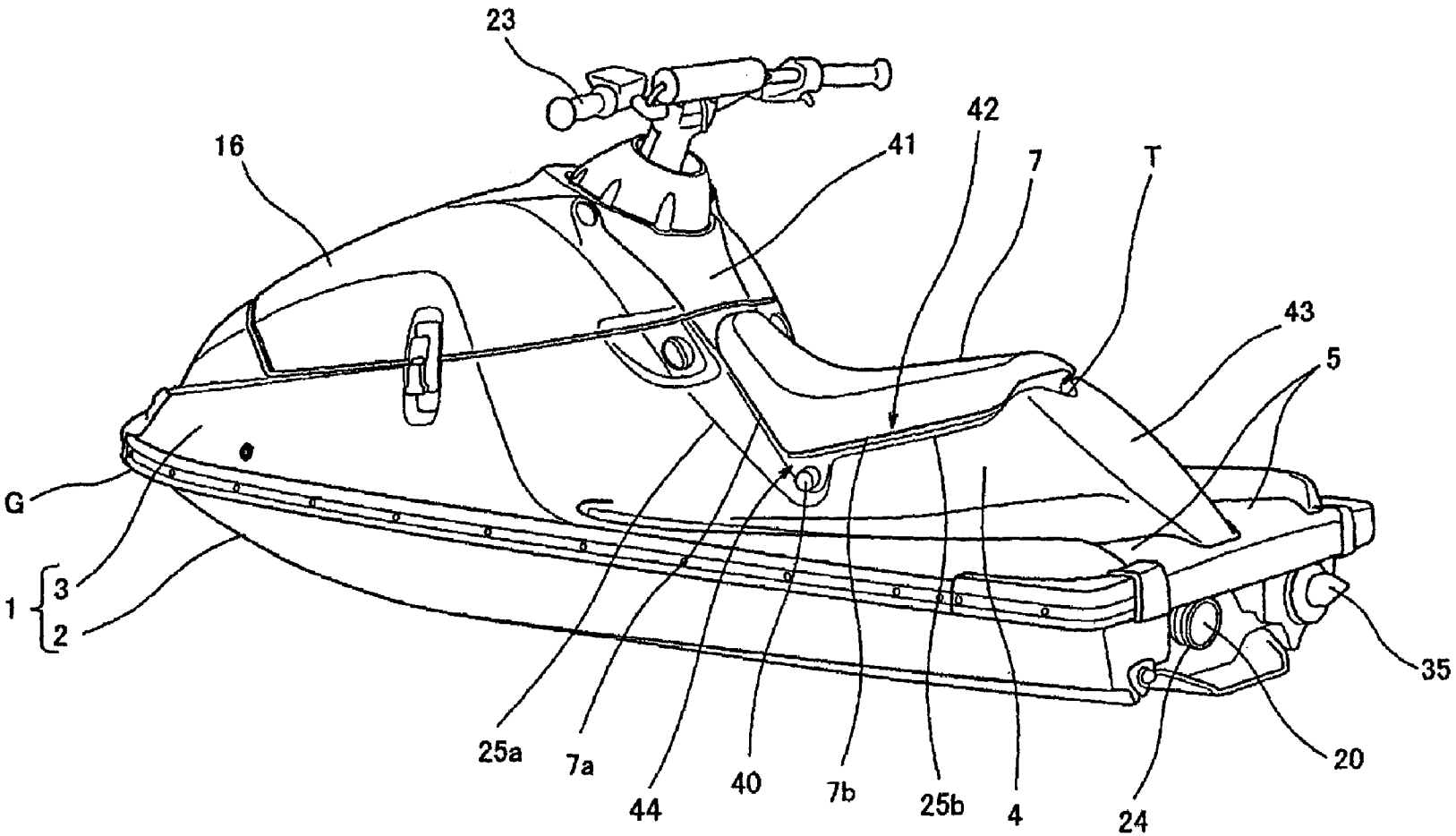
FIG. 4 is a perspective view of the personal watercraft of FIG. 1, as viewed from leftward and behind.

FIG. 1 is a side view of a personal watercraft according to the embodiment of the present invention. FIG. 2 is a side view of a water jet pump P which is a propulsion system of the personal watercraft of FIG. 1, a part of which is cut away. FIG. 3 is a plan view of the personal watercraft of FIG. 1. FIG. 4 is a perspective view of the personal watercraft of FIG. 1, as viewed from leftward and behind.

Turning to FIGS. 1 to 4, a straddle-type personal watercraft having a seat 7 straddled by a rider is shown. A body 1 of the watercraft includes a hull 2 and a deck 3 covering the hull 2 from above. To enable the rider to ride in the watercraft in a straddling position, a swelling portion 4 is raised upward at a center section in a lateral direction of a relatively rear portion of the deck 3. The seat 7 is mounted over an upper surface of the swelling portion 4. A deck floor 5 is formed on right and left sides of the swelling portion 4 to be substantially flat and lower than the swelling portion 4 to enable rider's feet to be put thereon. A line at which the hull 2 and the deck 3 are connected over the entire perimeter thereof is called a gunnel line G. In FIG. 1, reference symbol W indicates a waterline of the watercraft and the gunnel line G is located above the waterline W. As indicated by a broken line of FIG. 3, a deck opening 6 is formed at a substantially center section of the deck 3 on an upper region of the body 1 A hatch cover 16 is openably mounted over the deck opening 6.

As shown in FIG. 2, below the deck opening 6, a space defined by the hull 2 and the deck 3 forms an engine room 8. An engine E configured to drive the personal watercraft is mounted in the interior of the engine room 8. In this embodiment, the engine E is an in-line two-cylinder two-cycle engine, but is not intended to be limited to this.

The engine E is mounted such that a crankshaft 9 thereof extends along a longitudinal direction of the body 1. An output end of the crankshaft 9 is coupled to a propeller shaft 11 by a coupling means 10. The propeller shaft 11 is coupled to a pump shaft 12 of the water jet pump P mounted on the rear side of the body 1. The pump shaft 12 is configured to rotate integrally with the crankshaft 9. An impeller 13 is attached on the pump shaft 12. Fairing vanes 14 are disposed behind the impeller 13. The impeller 13 is covered with a tubular pump casing 15 on the outer periphery thereof.

A water intake 17 is provided on a bottom portion of the body 1. The water intake 17 is connected to the pump casing 15 through a water passage 18. A pump nozzle 19 is provided on the rear side of the body 1 and is coupled to the pump casing 15. The pump nozzle 19 has a cross-sectional area that is gradually reduced rearward, and an outlet port 20 is provided on the rear end of the pump nozzle 19.

In the above constructed personal watercraft, water is drawn from the water intake 17 at the bottom portion of the hull 2. The water jet pump P pressurizes and accelerates the water, and the fairing vanes 14 guide water flow. The water is ejected rearward through the pump nozzle 19 and from the outlet port 20. As the reaction of the water ejected from the outlet port 20, the personal watercraft obtains a propulsion force.

The engine E employs an open loop cooling system configured to directly cool the engine E and other components using water taken in from outside as the cooling water. A water drawing hole 21 is formed at a predetermined location of an upper region of the pump casing 15. A part of the water pressurized by the water jet pump P is drawn into the body of the watercraft from the water drawing hole 21 and through a cooling water pipe 22 to cool the engine E and other components. The cooling system of the engine E will be described in detail later.

A steering handle 23 is located forward of the seat 7. The handle 23 is coupled to a steering nozzle 24 behind the pump nozzle 19 via a cable (not shown). When the rider rotates the handle 23 clockwise or counterclockwise, the steering nozzle 24 is pivoted to the right or to the left so that the ejection direction of the water being ejected through the pump nozzle 19 can be changed, and the watercraft can be correspondingly turned to any desired direction while the water jet pump P is generating the propulsion force.

Figure 5:
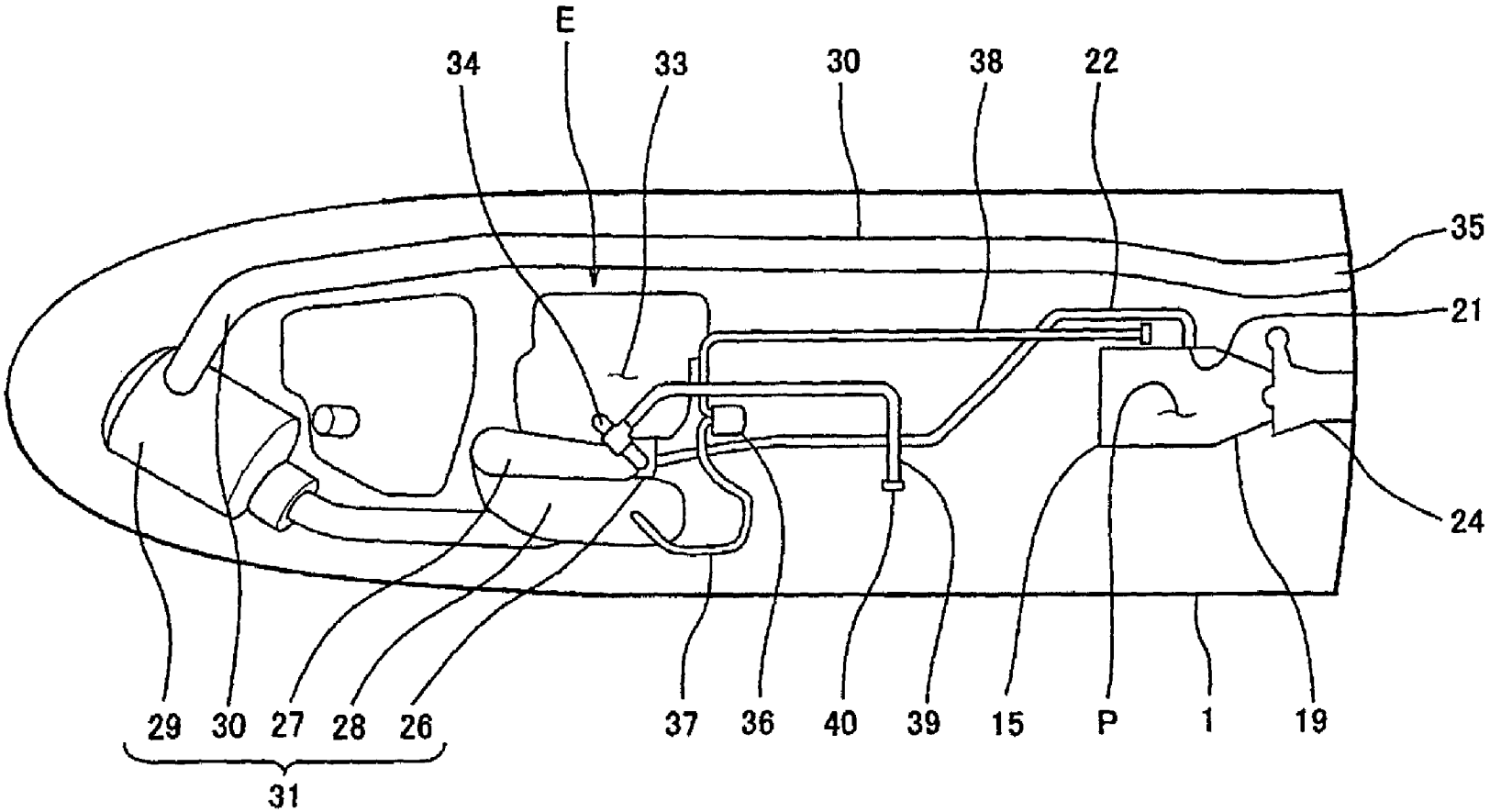
FIG. 5 is a plan view showing an example of a cooling system of an engine of the personal watercraft of FIG. 1.
Figure 6:
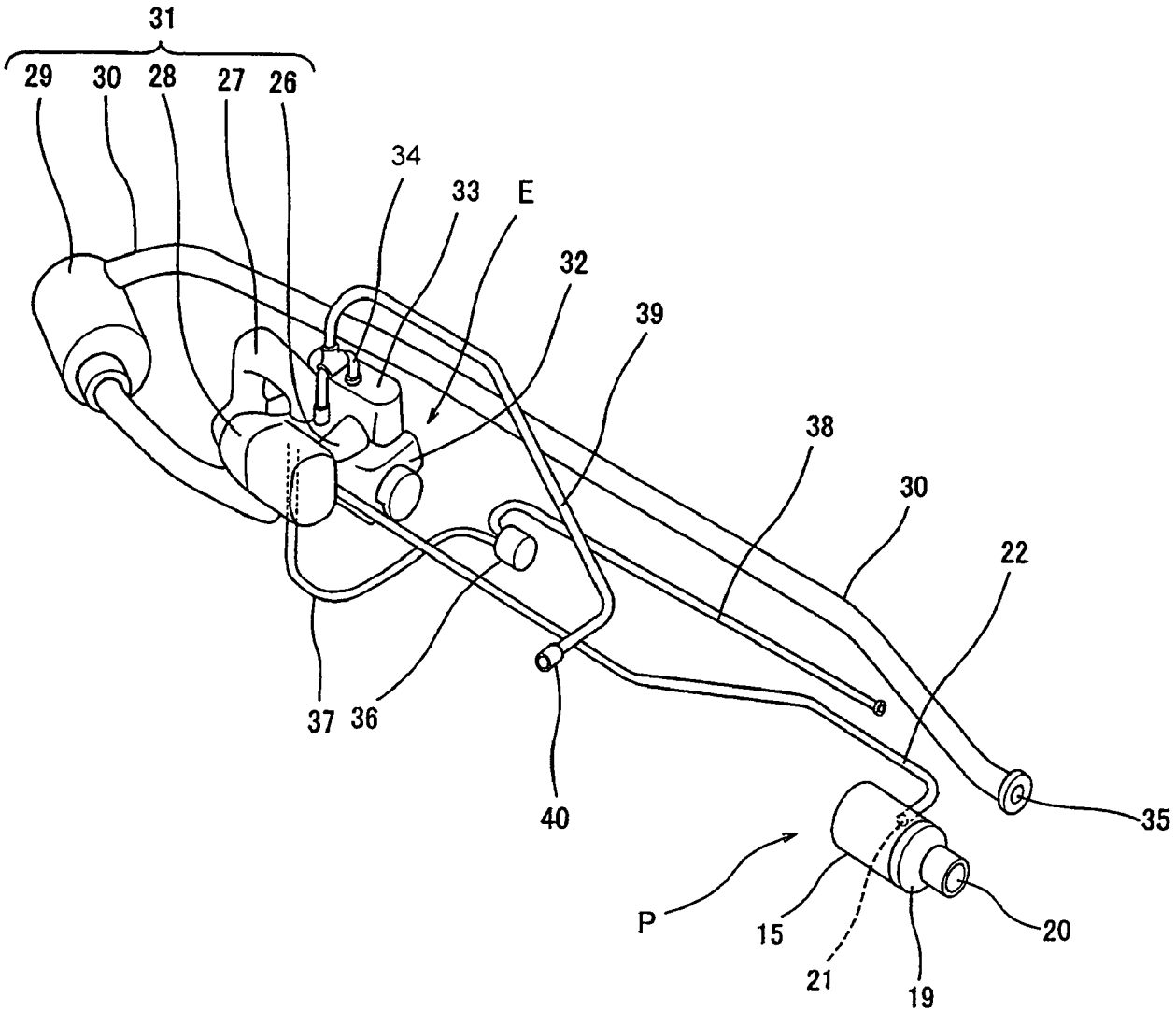
FIG. 6 is a perspective view showing the cooling system of FIG. 5.
Figure 7:
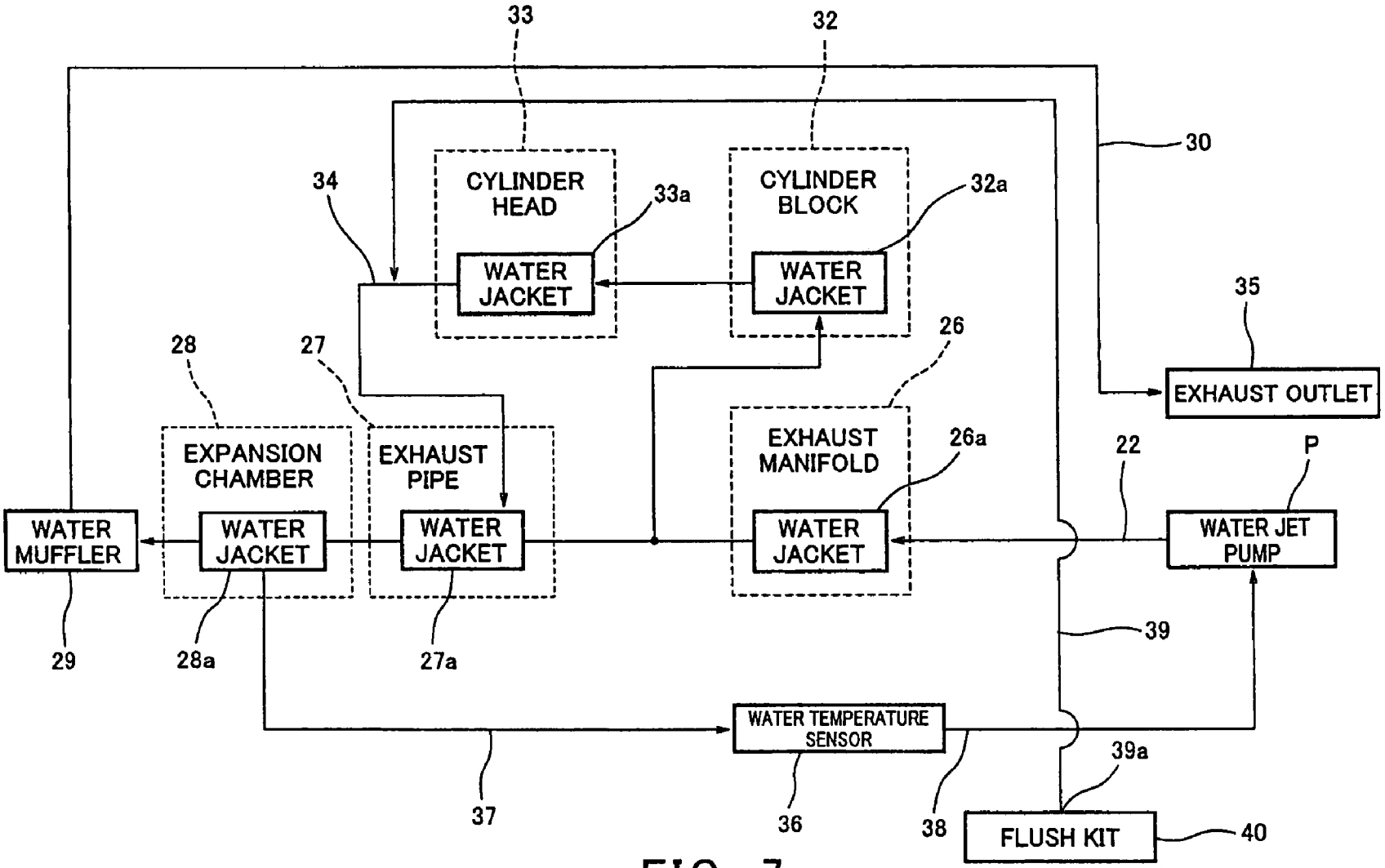
FIG. 7 is a block diagram showing the cooling system of FIG. 5.

FIGS. 5 and 6 are perspective views showing a construction of the cooling system of the engine E equipped in the personal watercraft of FIG. 1, and FIG. 7 is a block diagram thereof. As shown in FIGS. 5 and 6, an exhaust manifold 26 is coupled to the engine E, and to a cylindrical water muffler 29 disposed at a front portion of the body 1 through an exhaust pipe 27 and an expansion chamber 28. The water muffler 29 communicates with outside the watercraft at an aft of the watercraft through an exhaust duct 30 coupled to the water muffler 29. An exhaust passage 31 of the personal watercraft of this embodiment includes the exhaust manifold 26, the exhaust pipe 27, the expansion chamber 28, the water muffler 29, and the exhaust duct 30. An exhaust gas emitted from the engine E is discharged outside the watercraft through the exhaust passage 31.

The cooling water pipe 22 extends from the pump casing 15 of the water jet pump P to the exhaust manifold 26. The cooling water pipe 22 guides, to the engine E, a part of the water pressurized inside the water jet pump P.

As shown in FIG. 7, the cooling water pipe 22 connects the water jet pump P to a water jacket 26*a* formed in the exhaust manifold 26 to guide the cooling water pressurized by the water jet pump P to the water jacket 26*a*, i.e., to a cooling water passage formed in the interior of the exhaust manifold 26. The water jacket 26*a* of the exhaust manifold 26 is connected to a water jacket 27*a* formed in the exhaust pipe 27. So, the cooling water drawn into the exhaust manifold 26 through the cooling water pipe 22 is supplied to the water jacket 27*a* of the exhaust pipe 27. Since the water jacket 27*a* formed in the exhaust pipe 27 is connected to a water jacket 28*a* formed in the expansion chamber 28, the cooling water drawn into the exhaust pipe 27 is supplied to the water jacket 28*a* of the expansion chamber 28. Furthermore, the cooling water is supplied from the water jacket 28*a* to the exhaust gas flowing in the interior of the water muffler 29 and is discharged outside the watercraft together with the exhaust gas from an exhaust outlet 35.

The water jacket 26*a* formed in the exhaust manifold 26 is connected to a water jacket 32*a* of a cylinder block 32, which is in turn connected to a water jacket 33*a* of a cylinder head 33. Therefore, a part of the cooling water supplied to the water jacket 26*a* of the exhaust manifold 26 is divided to flow through the cylinder block 32 and the cylinder head 33 to cool them.

A connecting pipe 34 is coupled to an upper portion of the water jacket 33*a* of the cylinder head 33 to allow the water jacket 33*a* to communicate with the water jacket 27*a* of the exhaust pipe 27 therethrough. A water cleaning (also referred to as flush) pipe 39 is coupled to the connecting pipe 34. The cooling water delivered to the cylinder head 33 flows through the interior of the cylinder head 33 and to the exhaust pipe 27 and is mixed with the cooling water directly flowing from the exhaust manifold 26 to the exhaust pipe 27, and the resulting cooling water flows to the expansion chamber 28. Then, the cooling water is supplied to the exhaust gas in the interior of the water muffler 29 and is discharged outside the watercraft together with the exhaust gas through the exhaust outlet 30 and from the exhaust outlet 35.

A detection pipe 37 extends from the water jacket 28*a* of the expansion chamber 28 and is coupled to a water temperature sensor 36. A water discharge pipe 38 extends from the water temperature sensor 36 and is coupled to the water jet pump P. Thereby, a part of the cooling water that has cooled the engine E is delivered from the water jacket 28*a* of the expansion chamber 28 to the water temperature sensor 36, which detects water temperature of the cooling water, and is discharged into the water jet pump P.

The flush pipe 39 is equipped in the personal watercraft to clean the cooling system. In general, after cruising, the watercraft is landed and cleaning water (typically clean water such as city water) is flowed into the cooling water passage of the water cooling system and is discharged through an exhaust passage and the like, to clean (or flush) the cooling system. One end of the flush pipe 39 is coupled to the connecting pipe 34 forming a part of the cooling water passage. An opposite end of the flush pipe 39 is coupled to a predetermined location of a left side surface of the deck 3 and is configured to open to form a water inlet 39*a*. A water supply coupling member 40 (also referred to as a flush kit) by which the flush pipe 39 is coupled to a cleaning water supply pipe 53 (see FIG. 10) through which the cleaning water is supplied to the cooling system is attached to the water inlet 39*a*. In this embodiment, the flush kit 40 is attached on a left side surface of the swelling portion 4 at the center section of the deck 3 and is located immediately below the seat 7 (see FIGS. 1, 2, and 4). The flush pipe 39 may be constructed of a hard pipe made of metal or the like, or a flexible tube made of a soft synthetic resin or the like.

As shown in FIGS. 1 and 2, when the upper end surface of a region of the swelling portion 4 over which the seat 7 is mounted and the upper end surfaces of forward and rearward regions thereof are viewed from the side, a first inclined surface 41 that is inclined rearward and downward at a relatively large angle from a location where the steering handle 23 is attached, a second inclined surface 42 that is inclined rearward and upward at a small angle from a vicinity of a front portion of the seat 7, and a third inclined surface 43 that is inclined rearward and downward at a relatively large angle from a rear end of the seat 7 to an aft portion, are connected to each other. The seat 7 substantially conforms in shape to the first and second inclined surfaces 41 and 42 of the swelling portion 4. As viewed from the side, the lower surface of the seat 7 has at a front portion thereof a first lower surface 7*a* that is inclined forward and upward at a relatively large angle, and at a rear portion thereof a second lower surface 7*b* that is inclined rearward and upward at a relatively small angle. A first line 25*a* extending in close proximity to and substantially in parallel with the first inclined surface 41 and a second line 25*b* extending in close proximity to and substantially in parallel with the second inclined surface 42 are formed on the side surface of the swelling portion 4. Such a shape improves an appearance of a side surface shape of the entire watercraft.

The flush kit 40 is disposed in close proximity to a contact point of the first inclined surface 41 and the second inclined surface 42 of the left side surface of the deck, a contact point of the first lower surface 7*a* and the second lower surface 7*b* of the seat 7, and a contact point of the first line 25*a* and the second line 25*b*, i.e., at a bent region of the inclined surfaces or the inclined lines as viewed from laterally. The location of the flush kit 40 conforms to a bent region of the line indicating the lower surface of the seat 7 as viewed from laterally. In external design appearance of the body 1, the flush kit 40 is less noticeable and a beautiful line of an upper end surface of the watercraft is maintained. In addition, a concave portion 44 described later is easily formed at the bent region of the inclined surfaces.

As shown in FIGS. 3 and 4, a region of the left side surface of the swelling portion where the flush kit 40 is attached is concaved slightly inward. The flush kit 40 protrudes slightly from a bottom surface of the concave portion 44. The seat 7 has a width that is slightly larger than that of an upper surface of the swelling portion 4 over which the seat 7 is mounted. Therefore, the flush kit 40 protruding slightly from the concave portion 44 does not contact the foot of the rider. In addition, the flush kit 40 is less noticeable as viewed from above and from forward and rearward. The depth of the concave portion 44 is not specifically limited, but is desirably substantially as large as or larger than the height of the flush kit 40 protruding outward from the bottom surface of the concave portion 44 (see FIG. 8).

Instead of the left side surface of the swelling portion 4, the flush kit 40 may be disposed on a right side surface thereof or on each of the right and left side surfaces thereof. To dispose the flush kits 40 on the right and left side surfaces, one flush pipe 39 coupled to the connecting pipe 34 may be branched in Y-shape or in T-shape, and the branched pipes of the flush pipe 39 may be coupled to the right and left flush kits 40. In general, the left side of the body 1 is a port side, and therefore contacts a pier or a boatslip when the body 1 is anchored at the pier or at the boatslip. Therefore, the flush kit 40 is desirably located on the left side rather than the right side of the body 1 because the flush kit 40 can easily access cleaning water supply equipment in a case where the watercraft is lifted up with the body 1 anchored at the pier or the boatslip.

One end of the flush pipe 39 is coupled to the connecting pipe 34 by a T-shaped pipe joint or a Y-shaped pipe joint. The connecting pipe 34 is located at an upper end of the engine E to connect the cylinder head 33 to the exhaust pipe 27. Therefore, the flush pipe 39 is coupled at a higher location of the cooling water passage. This makes it possible to uniformly flow the cleaning water supplied from the water inlet 39*a* (FIGS. 7 and 9) of the flush kit 40 in the direction from the connecting pipe 34 to the cylinder head 33 and the cylinder block 32, and in the direction from the connecting pipe 34 to the exhaust pipe 27 and the water muffler 29. As a result, the cooling system can be effectively cleaned. The connecting location where the flush pipe 39 is coupled to the cooling system is not intended to be limited to the connecting pipe 34, but is desirably as high as possible in the cooling water passage of the cooling system. The flashing is carried out while rotating the engine E to discharge the cleaning water remaining in the interior of the water muffler 29 outside the watercraft by an exhaust pressure.

Figure 8:
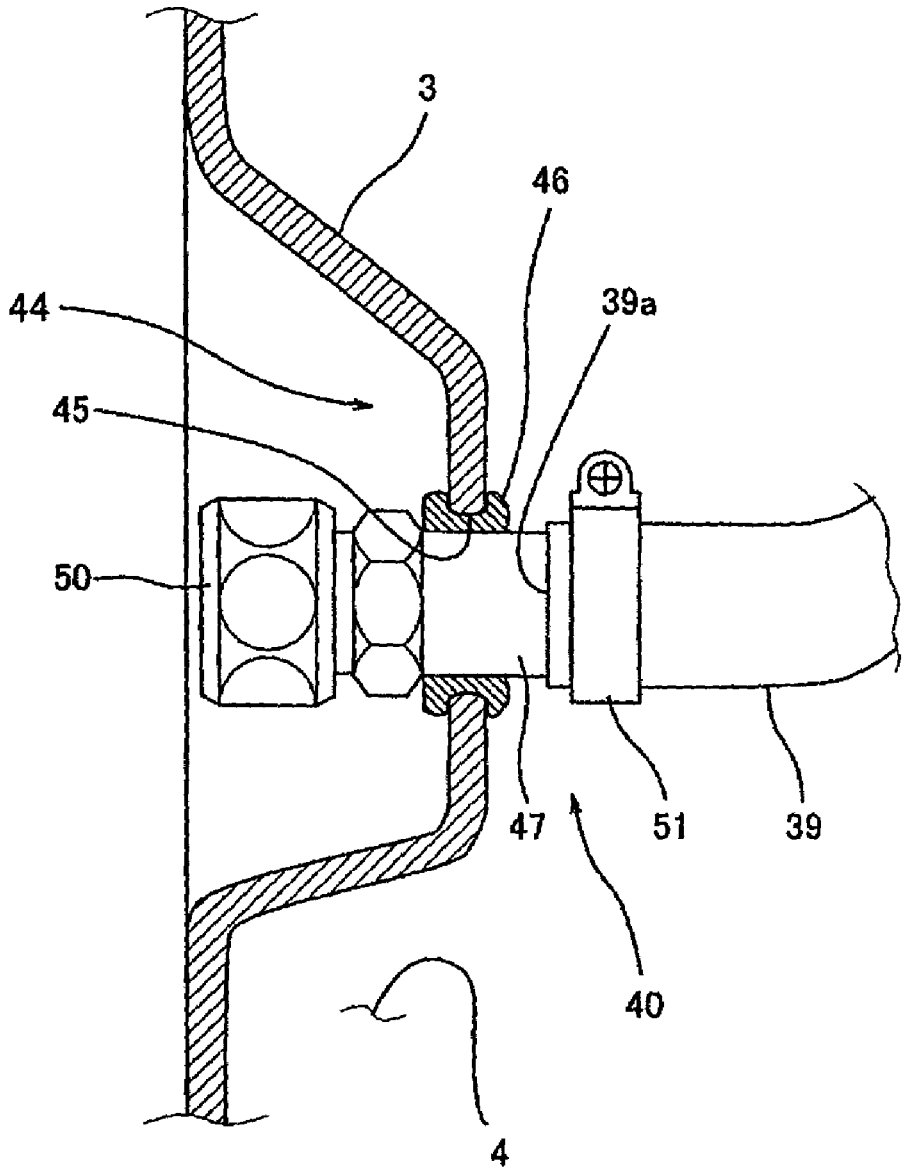
FIG. 8 is a cross-sectional view taken along line VIII-VIII of FIG. 1 and a partial cross-sectional plan view showing an example of a flush kit in the cooling system.
Figure 9:
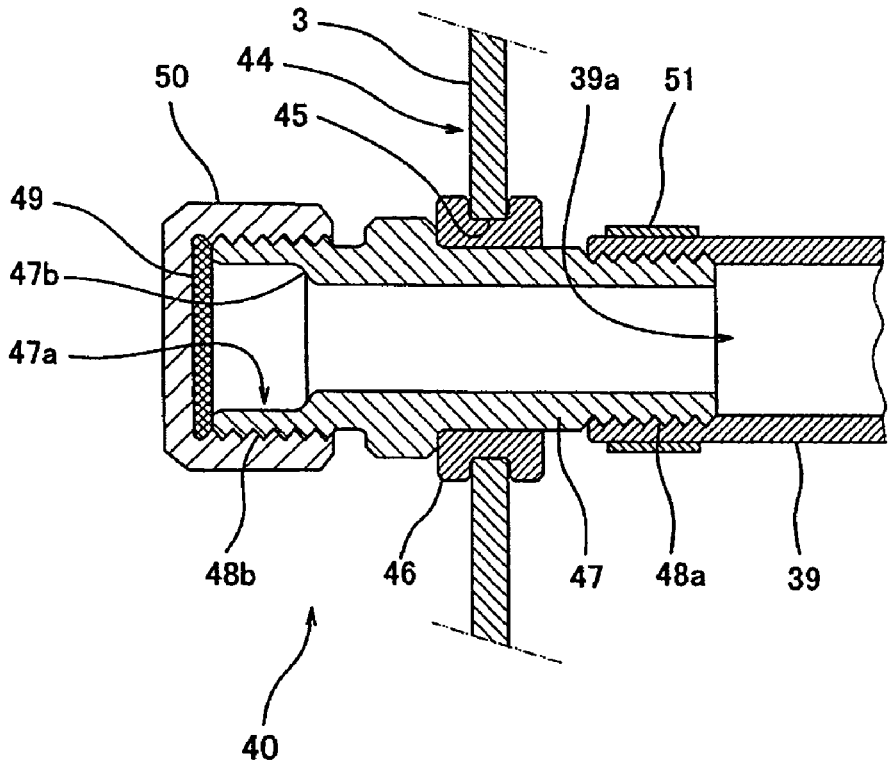
FIG. 9 is a cross-sectional view showing a state in which the flush kit of FIG. 8 is not in use.
Figure 10:
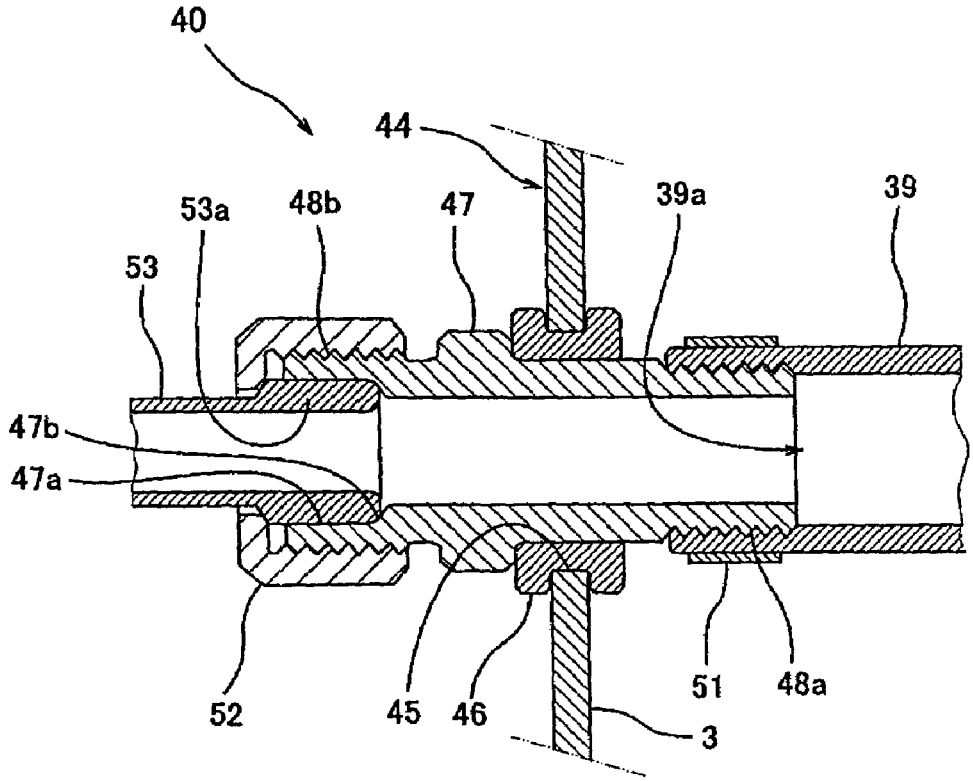
FIG. 10 is a cross-sectional view showing a state in which the flush kit of FIG. 8 is in use.
Figure 11:
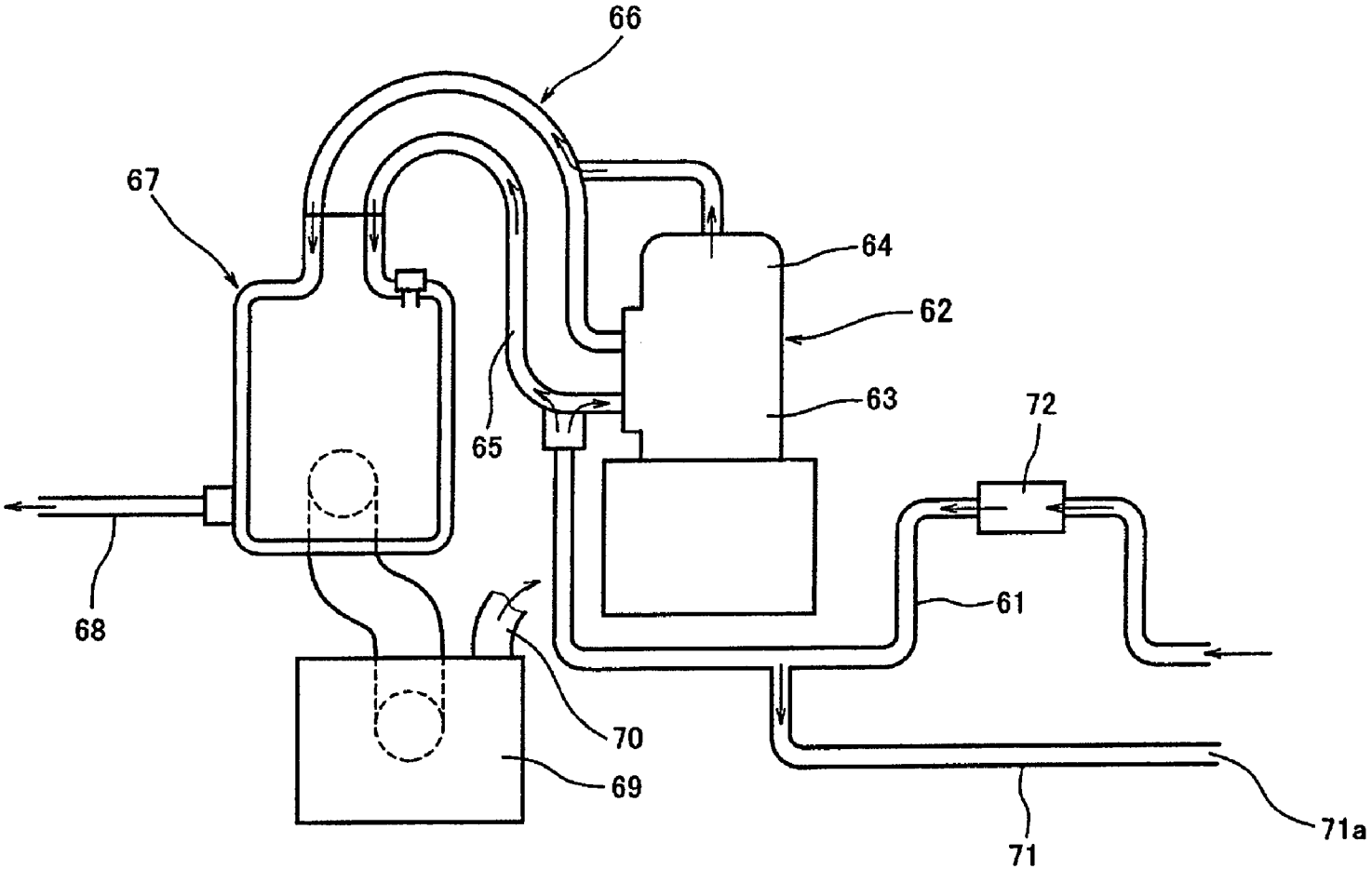
FIG. 11 is a conceptual diagram showing an example of a cooling system of the conventional personal watercraft.

FIGS. 8-10 show the flush kit 40 attached to the water supply inlet 39*a* of the flush pipe 39. FIGS. 8 and 9 show the flush kit 40 which is not in use and FIG. 10 shows the flush kit 40 in use. A mounting hole 45 of the flush kit 40 is formed on the concave portion 44 on the left side surface of the deck. A grommet 46 is fitted to the mounting hole 45. A joint pipe 47 which is a part of the flush kit 40 is mounted to penetrate through the grommet 46. Male threaded portions 48*a* and 48*b* are formed on outer peripheral surfaces of both ends of the joint pipe 47.

The flush pipe 39 is threadedly fitted to the male threaded portion 48*a* at a portion of the joint pipe 47 which is located inward of the body 1, and a fastener band 52 externally fastens the flush pipe 39 tightly. When the flush pipe 39 is a flexible tube or the like, the male threaded portion 48*a* may be omitted. While the flush kit 40 is not in use, a cap 50 is attached to the male threaded portion 48*b* at a portion of the joint pipe 47 which is located outward of the body 1, with a gasket 49 closing the water inlet 39*a* (FIG. 9). During travel of the watercraft, i.e., while the flush kit 40 is not in use, the cooling water reaching the flush kit 40 does not leak outside.

As shown in FIG. 10, during use of the flush kit 40, the cap 50 and the gasket 49 are removed from the male threaded portion 48*b*, and the cleaning water supply pipe 53 is coupled to the joint pipe 47 by a union nut 52 that has an opening at a center region thereof. To be specific, a large-diameter portion 53*a* formed on an outer periphery of an end portion of the cleaning water supply pipe 53 is inserted into a large-diameter portion 47*a* formed on an inner periphery of the joint pipe 47. Under this condition, the union nut 52 is externally fitted to the male threaded portion 48*a* of the joint pipe 47. Thereby, the periphery of the opening of the union nut 52 presses a tip end portion of the large-diameter portion 53*a* of the cleaning water supply pipe 53 against a step portion 47*b* at an inward end of the large-diameter portion 47*a* of the joint pipe 47. As a result, the flush kit 40 and the cleaning water supply pipe 53 are coupled to each other in a sealed state.

The flush kit is not intended to be limited to that having the above described construction, but may be any other suitable pipe joint which is easily removably attachable.

The location where the flush kit 40 is attached is not intended to be limited to the location in close proximity to the contact point of the first inclined surface 41 and the second inclined surface 42 illustrated in FIGS. 1 and 2. The flush kit 40 is desirably disposed at a location on the deck 3 where the flush kit 40 is less noticeable, or the rider is not interfered with the flush kit 40 when the rider access the body 1 and steers the watercraft. For example, the flush kit 40 is desirably disposed at a concave portion that is formed on an outer surface of the deck to be less noticeable, such as a bent region of the lines appearing on the external appearance of the deck (including a location in close proximity to the bent region). For example, the flush kit 40 is desirably at a rear portion of the deck and below the seat 7 where the flush kit 40 is substantially covered with the seat 7 from above, and thus does not degrades the external appearance of the watercraft, and the concave portion is easily formed, such as a concave portion (rectangular portion indicated by T in FIGS. 3 and 4) which is formed immediately below a rear end of the seat 7 to allow a mounting bolt of the seat 7 to be removably attached thereto.

The bent portion of the lines is not intended to be limited to a bent portion of lines indicating an outer shape of a side view, a front view, and a plan view of the watercraft, but may be a bent portion formed at a boundary between a surface of the deck 3 and removable components such as the hatch cover 16 or the seat 7, and a bent portion of the line created on the surface of the deck 3.

Typically, tools are accommodated in a space in the interior of the body 1 below the hatch cover 16 or below the seat 7. When the tools are used to remove and attach the cleaning water supply pipe 53 to the flush kit 40, the flush kit 40 is disposed in close proximity to the contact point of the first inclined surface 41 and the second inclined surface 42. This is convenient, because the flush kit 40 is disposed near the tools.

Whereas the straddle-type personal watercraft has been described in the above embodiment, the present invention is not intended to be limited to the straddle-type personal watercraft, but may be applied to, for example, a stand-up type personal watercraft that is not equipped with a seat, but is provided with a flat floor deck (standing deck) which is located at a center region of the deck behind the steering handle to allow the rider rides thereon in a standing position, and deck fins swollen from right and left sides of the floor deck.

Numerous modifications and alternative embodiments of the invention will be apparent to those skilled in the art in view of the foregoing description. Accordingly, the description is to be construed as illustrative only, and is provided for the purpose of teaching those killed in the art the best mode of carrying out the invention. The details of the structure and/or function maybe varied substantially without departing from the spirit of the invention and all modifications which come within the scope of the appended claims are reserved.

What is claimed is:

1. A personal watercraft comprising:

a body including a deck and a hull;

an engine accommodated in an interior of the body and having a water jacket:

a cooling system configured to cool the engine using water taken in from outside the watercraft;

a cleaning water supply line, one end of which is coupled to the cooling system to guide cleaning water to the cooling system and an opposite end of which has an opening;

a swelling portion on the deck, the swelling portion having a side surface and an upper end surface, the upper end surface having a bent portion as viewed in side view, wherein the opening is located in a concave portion formed in the side surface of the swelling portion so as to be proximate to the bent portion of the upper end surface of the swelling portion in the side view, the opening being formed to open outward;

a seat that is mounted to the upper end surface of the swelling portion and is configured to be straddled by a rider;

a coupling member that is attached to the opening to couple the cleaning water supply line to a cleaning water supply source located outside the body;

an exhaust system coupled to the engine and having a water jacket; and a connecting pipe for the cooling water that is disposed above the engine and is configured to connect an upper portion of the water jacket of the engine to an upper portion of the water jacket of the exhaust system; wherein the one end of the cleaning water supply line is coupled to the connecting pipe to supply from above the cleaning water separately to the engine and to the exhaust system.

2. The personal watercraft according to claim 1, wherein the swelling portion that is formed at a center section in a width direction of the deck and at a rear portion in a longitudinal direction of the deck; wherein the upper end surface of the swelling portion has a first inclined surface inclined rearward and downward and a second inclined surface extending from a rear end of the first inclined surface and inclined rearward and upward; and wherein the opening is formed on the side surface of the swelling portion and is located substantially just below the seat at a point where the first inclined surface and the second inclined surface contact each other as viewed from laterally.

3. The personal watercraft according to claim 2, wherein the side surface of the swelling portion is a left side surface of the body as viewed from rearward.

4. The personal watercraft according to claim 1, further comprising:

a water jet pump configured to be driven by the engine to propel the body of the watercraft; wherein the cooling system includes a first cooling system through which the cooling water is supplied from the water jet pump to the exhaust system and a second cooling system through which the cooling water is supplied from the water jet pump to the engine;

the second cooling system branches from the first cooling system and is merged into the first cooling system via the water jacket of the engine and the connecting pipe; and the cleaning water is caused to flow into the first cooling system and the second cooling system from the cleaning water supply line.

5. The personal watercraft according to claim 1, wherein the bent portion of the upper end surface of the swelling portion is V-shaped as viewed from the side and the opening is located to be proximate to a low point of the V-shaped bent portion.

* * * * *